US006581897B2

(12) United States Patent
Ruschke

(10) Patent No.: US 6,581,897 B2
(45) Date of Patent: Jun. 24, 2003

(54) FRACTURE FRAME MOUNTING APPARATUS, BRACKET, AND METHOD

(75) Inventor: Jeffrey A. Ruschke, Lawrenceburg, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/789,645

(22) Filed: Feb. 21, 2001

(65) Prior Publication Data

US 2001/0009042 A1 Jul. 26, 2001

Related U.S. Application Data

(62) Division of application No. 09/295,284, filed on Apr. 20, 1999, now Pat. No. 6,216,293.

(51) Int. Cl.[7] ..... A61G 7/00; A61G 7/05; A61G 7/053

(52) U.S. Cl. ..... 248/539; 5/662

(58) Field of Search ..... 5/658, 662, 600, 5/621–624, 613; 602/33–35; 248/539

(56) References Cited

U.S. PATENT DOCUMENTS

| | | | | |
|---|---|---|---|---|
| 841,560 A | * | 1/1907 | Morris | 248/539 |
| 1,699,026 A | * | 1/1929 | Schumacher et al. | 5/662 |
| 3,077,613 A | * | 2/1963 | Mayer | 5/662 |
| 3,565,380 A | | 2/1971 | Langren | |
| 3,585,992 A | | 6/1971 | Vessels | |
| 3,654,921 A | | 4/1972 | Neuhardt, Jr. | |
| 3,699,953 A | | 10/1972 | Mason | |
| 3,734,088 A | | 5/1973 | Tucker, Jr. et al. | |
| 3,765,411 A | | 10/1973 | Ward, Jr. | |
| 3,766,912 A | | 10/1973 | Daniels | |
| 3,800,787 A | | 4/1974 | Rush | |
| 3,850,165 A | | 11/1974 | Throner | |
| 3,856,003 A | | 12/1974 | Pfluger | |
| 3,943,524 A | * | 3/1976 | Sample | 248/539 |
| 4,144,880 A | | 3/1979 | Daniels | |
| 4,190,224 A | | 2/1980 | LeBlanc et al. | |
| 4,236,265 A | | 12/1980 | Carradine | |
| 4,489,713 A | | 12/1984 | Latenser | |
| 4,551,872 A | | 11/1985 | Reed | |
| 4,616,637 A | | 10/1986 | Caspari et al. | |
| 4,642,824 A | | 2/1987 | Hodges | |
| 4,648,144 A | | 3/1987 | Rose | |
| 4,730,606 A | | 3/1988 | Leininger | |
| 4,887,325 A | | 12/1989 | Tesch | |
| 5,010,880 A | | 4/1991 | Lamb | |
| 5,027,799 A | | 7/1991 | Laico et al. | |
| 5,039,056 A | * | 8/1991 | Paxton | 248/539 |
| 5,149,036 A | | 9/1992 | Sheehan | |
| 5,312,077 A | | 5/1994 | Gutierrez | |
| 5,358,205 A | | 10/1994 | Starkey et al. | |
| 5,401,236 A | | 3/1995 | Summerville | |
| 5,453,756 A | * | 9/1995 | Lowrey | 248/539 |
| 5,588,166 A | | 12/1996 | Burnett | |
| 5,657,884 A | | 8/1997 | Zilincar, III | |
| 5,662,591 A | | 9/1997 | Peindl et al. | |
| 5,676,158 A | | 10/1997 | Katzman et al. | |
| 5,806,117 A | | 9/1998 | Gotfried | |
| 5,836,026 A | | 11/1998 | Reed | |
| 6,290,194 B1 | | 9/2001 | Chaconas et al. | |

FOREIGN PATENT DOCUMENTS

| | | | | |
|---|---|---|---|---|
| DE | 362892 | * | 4/1922 | 5/662 |

* cited by examiner

*Primary Examiner*—Alexander Grosz
(74) *Attorney, Agent, or Firm*—Bose McKinney & Evans LLP

(57) ABSTRACT

A mounting bracket is provided for coupling a fracture frame to a patient-support apparatus.

31 Claims, 4 Drawing Sheets

FRACTURE FRAME MOUNTING APPARATUS, BRACKET, AND METHOD

This application is a divisional of U.S. application Ser. No. 09/295,284, filed Apr. 20, 1999, now U.S. Pat. No. 6,216,293 which is hereby incorporated by reference.

BACKGROUND AND SUMMARY OF THE INVENTION

The present invention relates to a mounting apparatus and particularly, to an apparatus for mounting a fracture frame to a patient-support apparatus, such as a hospital bed. More particularly, the present invention relates to a mounting apparatus that permits a hospital bed without a fracture frame to be upgraded to one that has a fracture frame attached thereto.

Fracture frames are commonly used in conjunction with hospital beds to support various types of traction equipment such as cables, pulleys, reels, hooks, straps and weights, just to name a few. It is also known to couple patient-positioning equipment such as trapeze bars to fracture frames. Conventional fracture frames may be either floor-supported or mounted directly to the hospital bed and usually include frame members that are positioned above a mattress of the hospital bed. Some floor-supported fracture frames cannot be moved simultaneously with movement of the hospital bed between locations. Many conventional fracture frames have multiple bed attachment points and thus, a variety of mounting devices for attaching fracture frames to hospital beds are known. It is desirable for fracture frame mounting devices to connect and disconnect from a hospital bed quickly and easily.

According to one aspect of the present invention, a patient-support apparatus includes a frame and a patient-support surface supported by the frame. The patient-support surface defines a footprint when projected downwardly onto a floor on which the patient-support apparatus sets. A mounting bracket is coupled to the frame beneath the patient-support surface and within the footprint. The mounting bracket includes a portion outside the footprint that is adapted to couple to a fracture frame.

In preferred embodiments, the mounting bracket includes an arm having a socket that receives a portion of a fracture frame to be coupled to the patient-support apparatus. A first mounting plate is coupled to the arm and extends therefrom and a second mounting plate is coupled to the arm and extends therefrom in spaced, parallel relation with the first mounting plate. The first and second mounting plates are spaced apart by a sufficient distance to allow a frame member of the patient-support apparatus to be received therebetween. In addition, the first and second mounting plates each include at least one aperture as does the frame member. The mounting bracket couples to the frame member by inserting a pin or bolt through the apertures of the mounting plates and frame member.

According to another aspect of the present invention, four mounting brackets are coupled to the frame of the patient-support apparatus such that sockets of the four mounting brackets define corners of a rectangle. In one embodiment of the present invention, the mounting brackets are constructed so as to have substantially the same size and shape.

According to yet another aspect of the present invention, a patient-support apparatus includes a frame and a patient-support deck supported relative to the frame. The patient-support deck includes a deck section that pivots relative to the frame between a first position and a second position. A pair of mounting brackets are coupled to the frame. Each mounting bracket includes an arm extending from the frame and each arm includes a portion to which a fracture frame couples. A deck-receiving space is defined between the arms. At least a portion of the deck section is positioned to lie in the deck-receiving space between the arms when the deck section is in the second position.

Additional features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
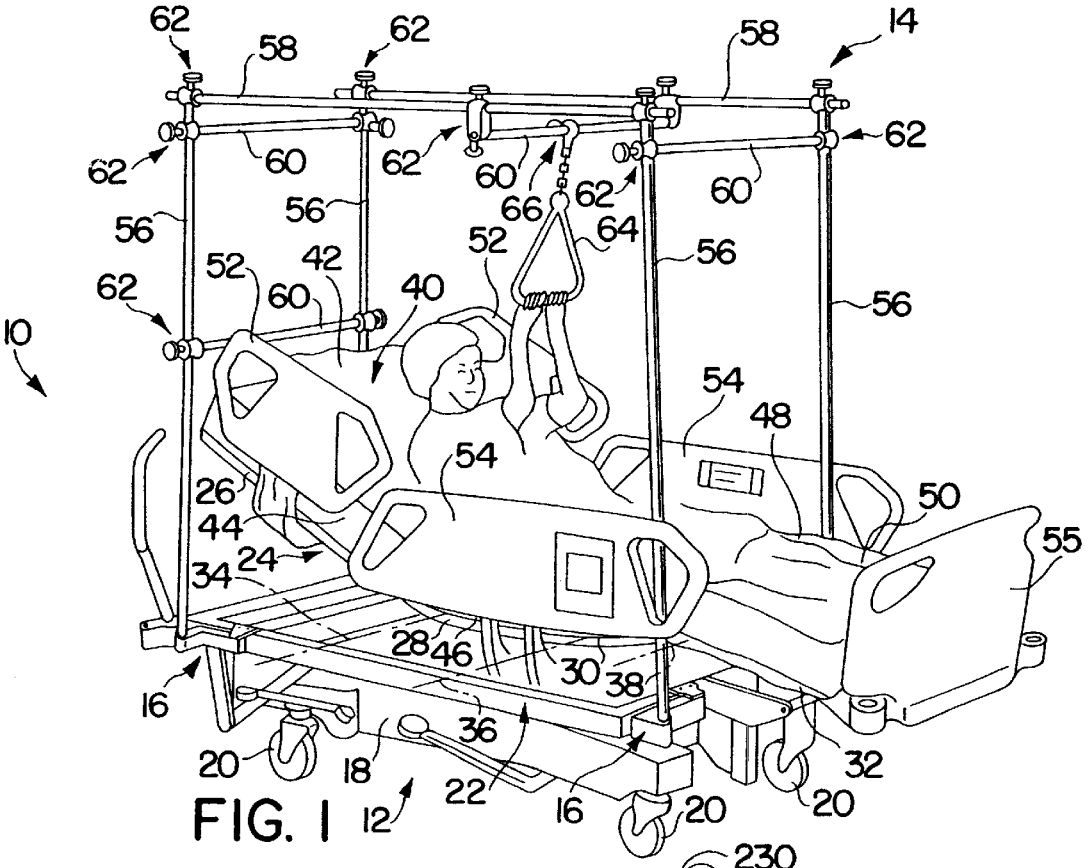
FIG. 1 is a perspective view of a hospital bed showing a fracture frame mounted to the hospital bed with a plurality of mounting brackets in accordance with the present invention.

A patient-support apparatus 10, such as a hospital bed 12, may have a fracture frame 14 attached thereto by a plurality of mounting brackets 16 in accordance with the present invention as shown in FIG. 1. Hospital bed 12 includes a base frame 18 and, in preferred embodiments, has a plurality of casters 20 coupled to base frame 18 so that bed 12 can be rolled along the floor on which bed 12 sets. Hospital bed 12 further includes an intermediate frame 22 and an elevation mechanism (not shown) coupling intermediate frame 22 to base frame 18. The elevation mechanism is operable to selectively raise, lower and tilt intermediate frame 22 relative to base frame 18.

Hospital bed 12 includes an articulated patient-support deck 24 which, in the illustrated embodiment, has a head section 26, a seat section 28, a thigh section 30, and a foot section 32. Seat section 28 is fixed to intermediate frame 22 and head section 26 is coupled to seat section 28 for pivoting movement about a transverse axis 34 between a horizontal position and a substantially vertical position. In addition, thigh section 30 is coupled to seat section 28 for pivoting movement about a transverse axis 36 and foot section 32 is coupled to thigh section 30 for pivoting movement about a transverse axis 38. Although illustrative bed 12 includes four deck sections 26, 28, 30, 32, it is within the scope of the invention as presently perceived for bed 12 to have a different number of deck sections.

Hospital bed 12 includes a mattress 40 having an upwardly facing patient-support surface 42 on which a patient rests as shown in FIG. 1. Mattress 40 includes a head portion 44, a seat portion 46, a thigh portion 48, and a foot portion 50. Portions 44, 46, 48, 50 are supported by deck sections 26, 28, 30, 32, respectively. Hospital bed 12 further includes drive mechanisms (not shown) that operate to articulate sections 26, 30, 32 (and corresponding portions 44, 48, 50) relative to seat section 28 and relative to intermediate frame 22. Deck sections 26, 28, 30, 32 can be moved to a multitude of positions including a flat, horizontal position in which the portions of surface 42 associated with respective mattress portions 44, 46, 48, 50 are substantially coplanar and a chair position in which head section 26 extends substantially vertically upwardly from seat section 28 and in which foot section 32 extends substantially vertically downwardly from thigh section 30.

It will be appreciated that various mechanical and electromechanical actuators and drivers may be used to raise and lower intermediate frame 22 relative to base frame 18 and to articulate deck sections 26, 28, 30, 32. It is well-known in the hospital bed art that electric, hydraulic, and pneumatic actuators in combination with various types of transmission elements including lead screw drives and various types of mechanical linkages may be used to create relative movement of portions of hospital beds and other patient-support apparatus. As a result, the terms "elevation mechanism(s)" and "drive mechanism(s)" is intended to cover all types of mechanical, electromechanical, hydraulic, and pneumatic mechanisms, including manual cranking mechanisms of all types, and including combinations thereof such as hydraulic cylinders in combination with electromechanical pumps for pressurizing fluid received by the hydraulic cylinders.

Illustrated hospital bed 12 includes a pair of first siderails 52 coupled to head section 26 and a pair of second siderails 54 coupled to seat section 28 as shown in FIG. 1. Each of siderails 52, 54 is independently movable between a raised position extending above patient-support surface 42 of mattress 40, as shown in FIG. 1, and a lowered position (not shown) positioned below patient-support surface 42. Bed 12 also includes a footboard 55 coupled to foot section 32 and extending upwardly therefrom. Additional details of hospital bed 12, as well as alternatives thereof, can be found in U.S. Pat. Nos. 5,454,126; 5,479,666; 5,630,238; 5,682,631; 5,692,256; 5,715,548; 5,724,685; 5,732,423; 5,745,937; 5,771,511; 5,781,949; and 5,790,997; each of which are assigned to the assignee of the present invention and each of which are hereby incorporated herein by reference.

Fracture frame 14 includes a plurality of frame members, including vertical frame members 56, longitudinal frame members 58, and transverse frame members 60 as shown in FIG. 1. At least portions of each of illustrative frame members 56, 58, 60 are hexagonal in cross section which is a well-known shape for fracture frame members in the healthcare industry. Fracture frame 14 further includes couplers 62 that couple frame members 56, 58, 60 to one another. It will be appreciated that frame members having shapes and cross sections that differ from those of illustrative frame members 56, 58, 60 may be mounted to bed 10 with brackets 16 without exceeding the scope of the invention as presently perceived. In addition, it is understood that any type of suitable couplers for coupling one of frame members 56, 58, 60 to any other of frame members 56, 58, 60 may be used in lieu of couplers 62.

Various types of traction equipment (not shown) such as cables, pulleys, reels, hooks, straps and weights may be coupled to fracture frame 14. Such equipment may also be coupled to a patient's limbs, head, or torso so as to immobilize the patient on bed 12 or so as to exert a force on the patient in a desired manner. Frame members 56, 58, 60 cooperate with the traction equipment so that forces exerted on the patient are directed in the proper directions. Other equipment such as a trapeze bar 64 may be coupled to fracture frame 14 with a suitable coupler 66 as shown in FIG. 1. A patient may grip trapeze bar 64 for assistance while entering or exiting bed 12 and also may grip trapeze bar 64 for purposes of repositioning while remaining in bed 12.

Figure 2:
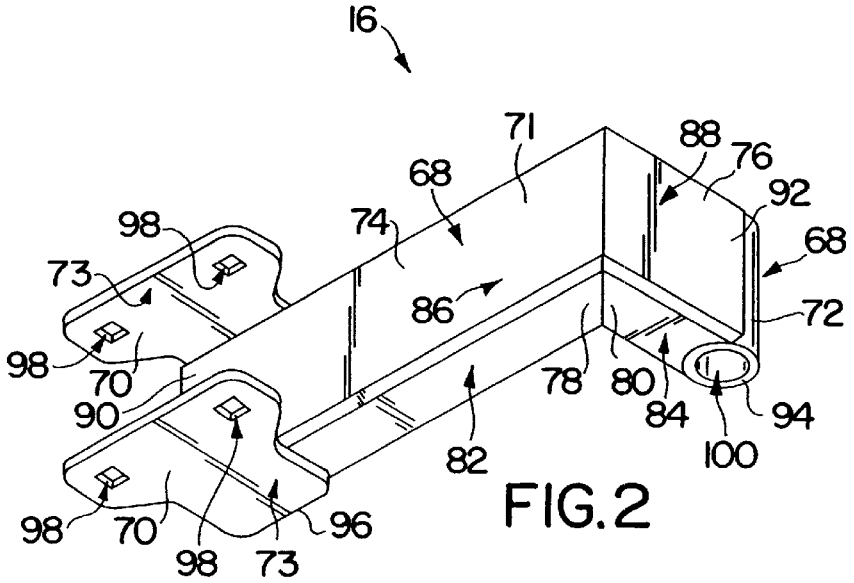
FIG. 2, is a perspective of one of the mounting brackets showing an L-shaped structural member, a pair of horizontal mounting plates appended to a first end of the L-shaped structural member, and a vertical socket tube appended to a second end of the L-shaped structural member.
Figure 3:
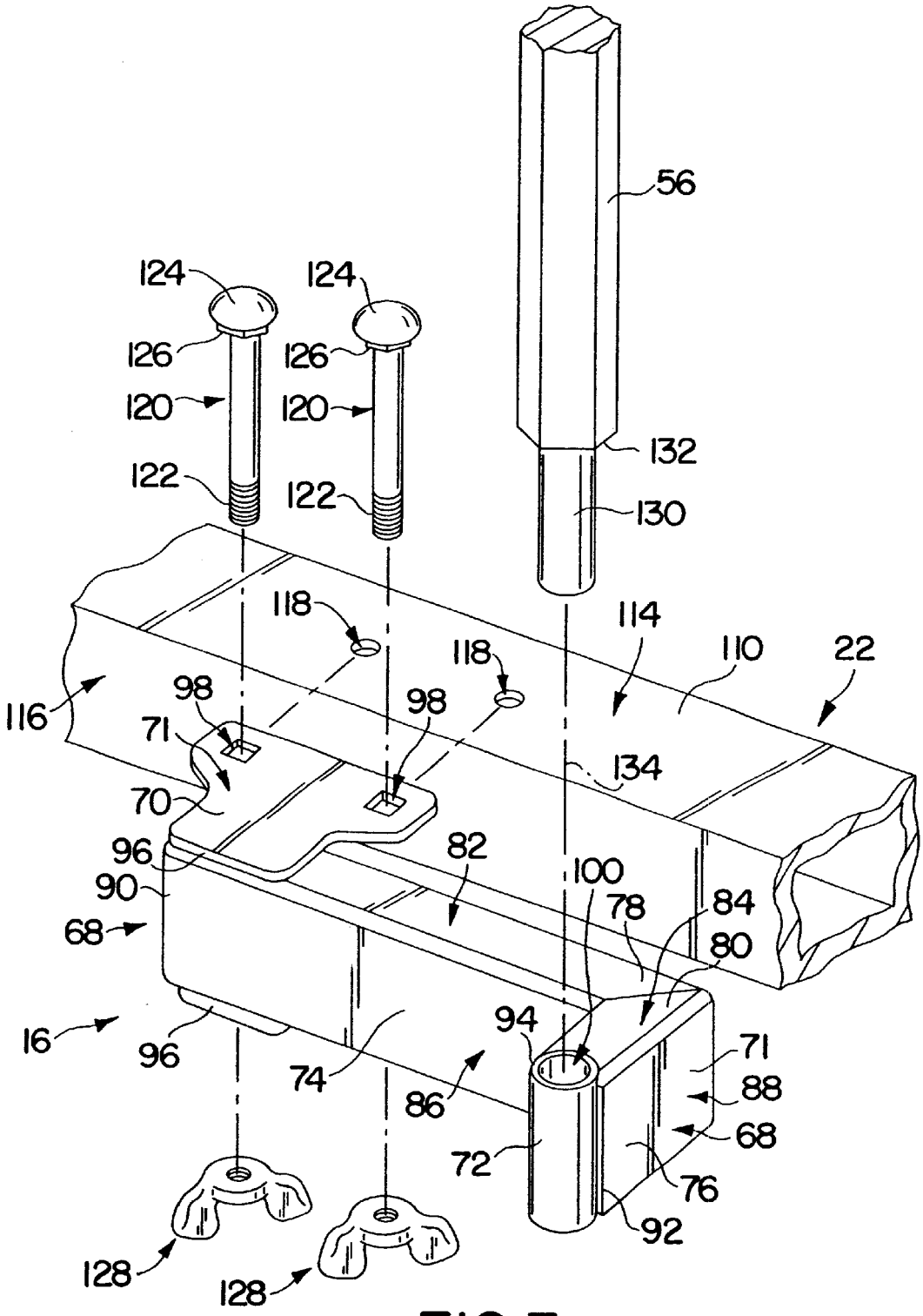
FIG. 3 is an exploded perspective view, with portions broken away, showing the mounting bracket of FIG. 2 arranged for attachment to an intermediate frame of the hospital bed, a pair of bolts arranged for insertion through apertures formed in the mounting plates and apertures formed in the intermediate frame, a pair of wing nuts arranged beneath the mounting bracket, and a lower portion of a fracture frame member arranged for insertion into the vertical socket tube of the mounting bracket.

Mounting brackets 16 in accordance with the present invention each include an arm 68 and a pair of mounting plates 70 coupled to arm 68 as shown in FIGS. 2 and 3. Arm 68 illustratively includes a structural member 71, and a socket tube 72. Socket tube 72 is coupled to structural member 71 and is spaced apart from mounting plates 70. Illustratively, structural member 71 is an L-shaped structure having a first portion 74 and a second portion 76. In the illustrated embodiments, portions 74, 76 are made from pieces of metal tube stock having rectangular cross section. A beveled end 78 of first portion 74 is appended, such as by welding or any other manner of coupling, to a beveled end 80 of second portion 76 so that horizontal surfaces 82 of first portion 74 are substantially coplanar with horizontal surfaces 84 of second portion 76 and so that vertical surfaces 86 of first portion 74 are substantially perpendicular to vertical surfaces 88 of second portion 76.

First portion 74 includes a distal end 90 spaced apart from beveled end 78 and second portion 76 includes a distal end 92 spaced apart from beveled end 80. Mounting plates 70 are appended, such as by welding or any other manner of coupling, to respective surfaces 82 adjacent to distal end 90. Mounting plates 70 extend from first portion 74 in a direction opposite to the direction that second portion 76 extends from first portion 74 as shown FIGS. 2 and 3. Socket tube 72 is appended, such as by welding or any other manner of coupling, to distal end 92 of second portion 76. In addition, socket tube 72 includes end edges 94 that are substantially coplanar with surfaces 82, 84, as shown in FIGS. 2 and 3, and mounting plates 70 each include an edge 96 that is substantially coplanar with one of surfaces 86, as shown best in FIG. 3. In preferred embodiments, mounting plates 70 are flat and therefore, each mounting plate 70 has upper and lower surfaces 71, 73 that are parallel with surfaces 82, 84.

Although arm 68 includes L-shaped structural member 71 and socket tube 72 appended thereto, it is within the scope of the invention as presently perceived for structural member 71 to have other configurations. For example, arm 68 may have other shapes and fracture frame members may couple to arm 68 by some manner other than a socket tube. In addition, arm 68 may have a receptacle formed directly therein without the need to provide a separate structural member and socket tube.

Mounting plates 70 extend from first portion 74 in substantially parallel relation with one another and each mounting plate 70 is formed to include a pair of apertures 98 that, in the illustrated embodiment, are square shaped. Each aperture 98 of the pair of apertures 98 associated with one of mounting plates 70 is aligned with a corresponding aperture 98 of the pair of apertures 98 associated with the other of mounting plates 70 as shown, for example, in FIG. 2. Illustrative socket tube 72 is formed to include a cylindrical bore 100 extending through socket tube 72 between end edges 94 thereof. It is, however, within the scope of the invention as presently perceived, for any suitable receptacle to be formed in arm 68.

Figure 4:
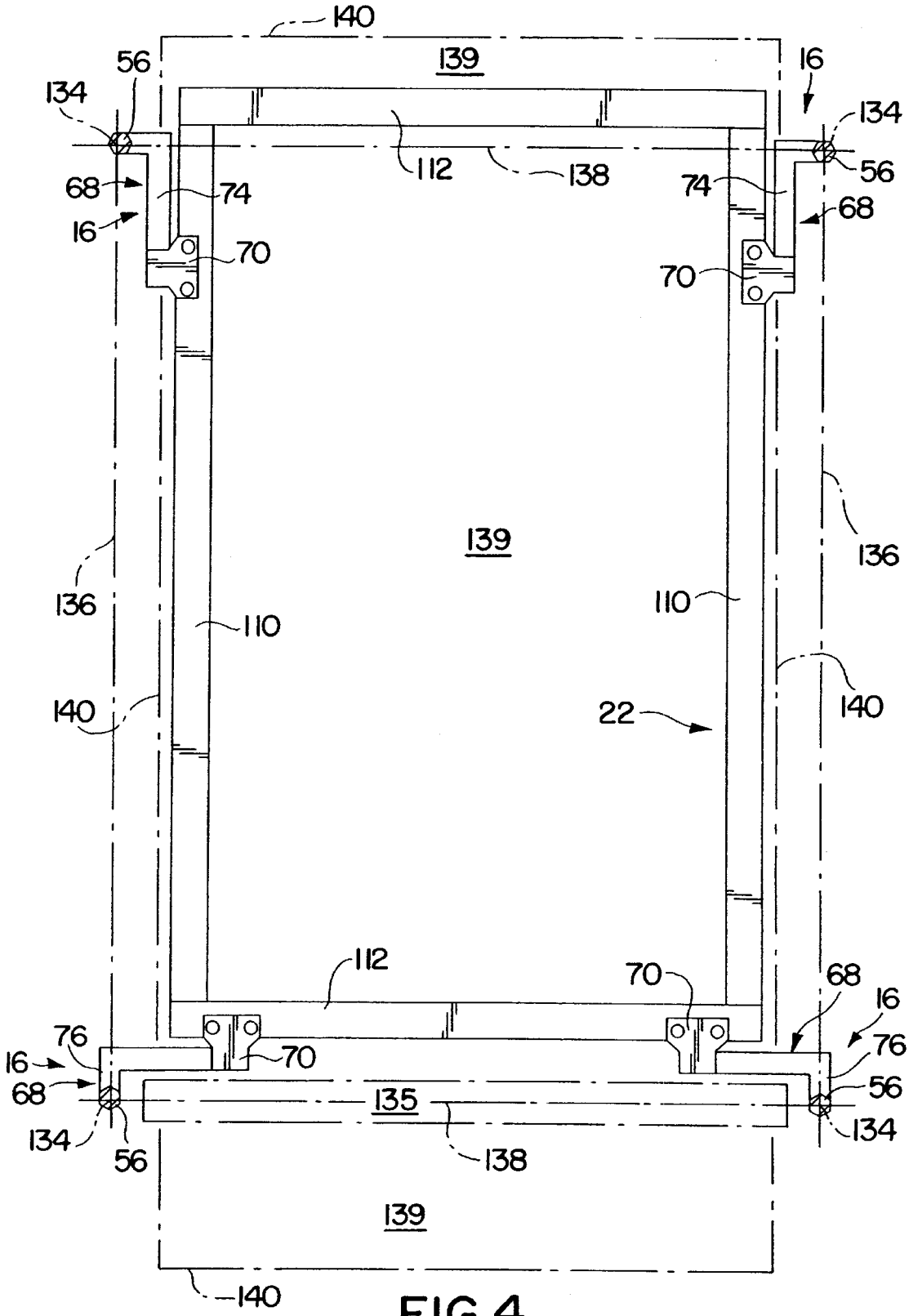
FIG. 4 is a diagrammatic top plan view of a plurality of mounting brackets mounted to the intermediate showing the socket tubes arranged to form a rectangular pattern.

Illustrative intermediate frame 22 of bed 12 comprises a pair of longitudinal frame members 110 and a pair of transverse frame members 112 as shown diagrammatically in FIG. 4. Those skilled in the art will appreciate that intermediate frames of hospital beds may include one solid frame or may consist of separate frame subassemblies that are coupled together. For example, intermediate frames including a first frame and a weigh frame that is coupled to the first frame by load cells having output signals indicative of the weight supported by the weigh frame relative to the first frame are known. In addition, intermediate frames having a first frame and a retracting second frame that retracts and extends relative to the first frame are also known. Thus the phrase "intermediate frame" or "frame" as used in the specification and in the claims is intended to cover all types of frames including one piece frames and including frames having multiple frame subassemblies.

In preferred embodiments, frame members 110, 112 are made of tubular bar stock having either rectangular or square cross section as shown best in FIG. 3 with reference to one of frame members 110. Preferred frame members 110, 112, therefore, have horizontal surfaces 114 and vertical surfaces 116. Mounting brackets 16 are configured such that the spacing between mounting plates 70 is slightly larger than the spacing between surfaces 114 of frame members 110, 112 so that mounting brackets 16 can be arranged having the respective frame member 110, 112 positioned to lie between mounting plates 70 with a minimal amount of clearance therebetween.

Frame members 110 and the frame member 112 adjacent the foot section 32 of bed 12 are each formed to include a suitable number of pairs of apertures 118, shown in FIG. 3, extending therethrough between horizontal surfaces 114 to allow attachment of mounting brackets 16. When apertures 98 formed in mounting plates 70 are aligned with apertures 118 formed in the respective frame member 110, 112, a pair of bolts 120 are inserted through apertures 98, 118 to couple the respective mounting bracket 16 to intermediate frame 22 of bed 12. Bolts 120 each include a threaded portion 122, a head 124, and a square-shaped lug 126. Square-shaped apertures 98 are sized so that lugs 126 are received therein. A wing nut 128 is threadedly coupled to each respective threaded portion 122 to secure the corresponding mounting bracket 16 to frame 22. Receipts of lugs 126 in apertures 98 prevents bolts 120 from turning during tightening of wing nuts 128.

Mounting bracket 16 includes socket tube 72 having cylindrical bore 100 as previously described. Each vertical frame member 56 of fracture frame 14 includes a cylindrical lower portion 130 as shown best in FIG. 3. After attachment of mounting bracket 16 to intermediate frame 22, lower portion 130 of vertical frame member 56 is inserted into bore 100 thereby coupling fracture frame 14 to mounting bracket 16. A shoulder surface 132 extending radially outwardly from portion 130 abuts one of end edges 94 of socket tube 72 under the force of gravity to maintain fracture frame 14 in place relative to mounting bracket 16 and relative to intermediate frame 22. Optionally, additional components, such as latches, pins, nuts, or bolts, may be provided to further secure frame member 56 to mounting bracket 16 although it has been found that, with respect to the illustrated embodiments, suitable coupling of fracture frame 14 to mounting brackets 16 is achieved without such additional components.

Each socket tube 72 defines a vertical axis 134 as shown in FIGS. 3 and 4. By appropriately configuring arms 68 of mounting brackets 16 and by appropriately locating apertures 118 formed in frame members 10, 112 of intermediate frame, vertical axes 134 cooperate with one another such that, when viewed from above (or below), a rectangle is formed having sides 136 and ends 138 and having the corners thereof at the respective vertical axes 134 as shown in FIG. 4. When lower portions 130 of vertical frame members 56 of fracture frame 14 are received in socket tubes 72, frame members 56 extend vertically along vertical axes 134 which allows transverse frame members 60 of fracture frame 16 to each have a common first length and which allows longitudinal frame members 58 to each have a common second length.

The arms 68 of mounting brackets 16 that are coupled to intermediate frame 22 adjacent to foot section 32 define a deck-receiving space 135 therebetween as shown in FIG. 4. Patient-support deck 24 of hospital bed 12 is movable between the flat, horizontal position and the chair position as previously described. When deck 24 moves toward the chair position from the horizontal position, foot section 32 pivots relative to intermediate frame 22 from a first position outside of deck-receiving space 135 to a second position in which at least a portion of foot section 32 is positioned to lie in deck receiving space 135.

When deck 24 is in the horizontal position, patient-support surface 42 defines a footprint 139, shown in FIG. 4, when projected downwardly onto a floor surface on which bed 12 sets. Footprint 139 is bounded by double-dashed perimeter lines 140. Mounting brackets 16 are each coupled to intermediate frame 22 within footprint 139 (meaning inside a volume defined between the floor, the patient-support surface 42, and vertical planes passing through perimeter lines 140). Socket tubes 72 are each positioned to lie outside footprint 139 (meaning outside the volume defined between the floor, the patient-support surface 42, and vertical planes passing through perimeter lines 140) and vertical frame members 56 are, therefore, positioned to lie outside footprint 139 as well. Thus, mounting brackets 16 are configured such that fracture frame 14 will not interfere with movement of deck 24 between the horizontal and chair positions.

It will be appreciated that any mounting brackets which are configured so that the points of attachment of frame 14 to frame 22 form a rectangular pattern, having the corners of the rectangle outside footprint 139, are within the scope of the invention as presently perceived. As shown in FIG. 4, four mounting brackets 16, each being constructed of similar size and shape, are attached to frame 22 so as form the rectangular pattern. Each mounting bracket 16 is simply oriented in the proper manner and then attached to frame 22 as previously described. However, it is not necessary that each mounting bracket be constructed of similar size and shape. For example, the mounting brackets attached to frame 22 adjacent foot section 32 may be sized and shaped differently than the mounting brackets attached to frame 22 adjacent head section 26. Mounting brackets 16 adjacent to head section 26 could be altered such that both first portions 74 thereof are lengthened, or alternatively shortened, by an equivalent amount and a rectangular pattern will still be maintained. In a similar fashion, mounting brackets adjacent to foot section 32 could be altered such that both second portions 76 thereof are lengthened, or alternatively shortened, by an equivalent amount and a rectangular pattern will still be maintained.

Figure 5:
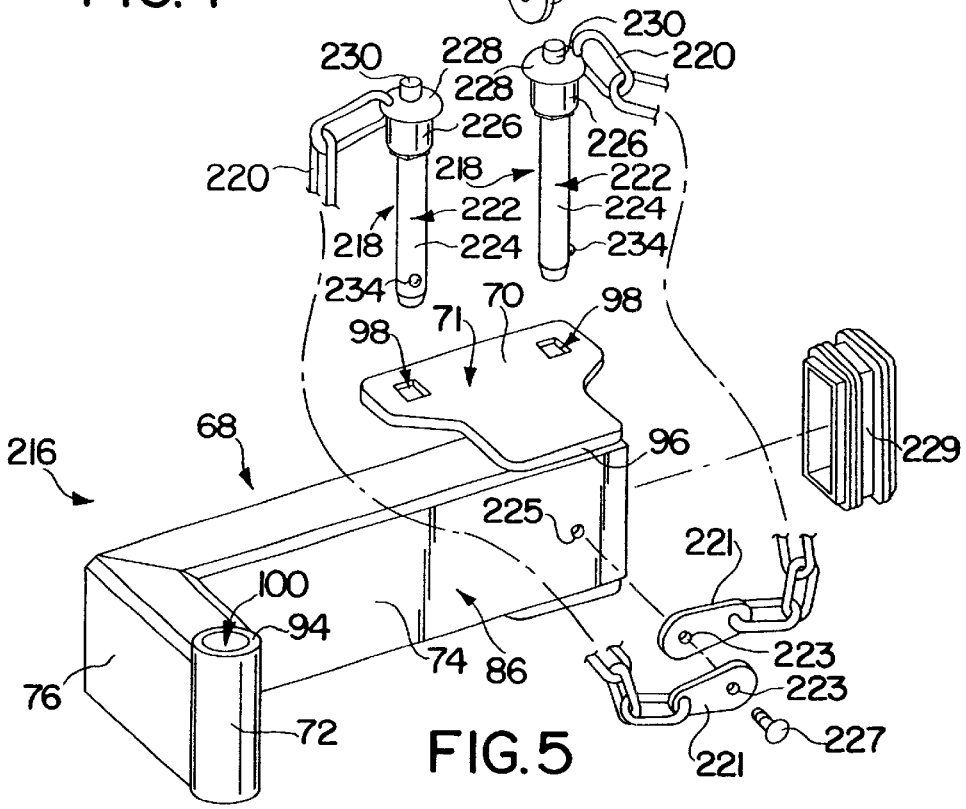
FIG. 5 is an exploded perspective view, with portions broken away, showing an alternative embodiment mounting bracket having an L-shaped structural member, a pair of horizontal mounting plates appended to a first end of the L-shaped structural member, a vertical socket tube appended to a second end of the L-shaped structural member, an end plug arranged for insertion into an end of the L-shaped structural member, and a pair of mounting pins tethered to the L-shaped structural member with chains.
Figure 6:
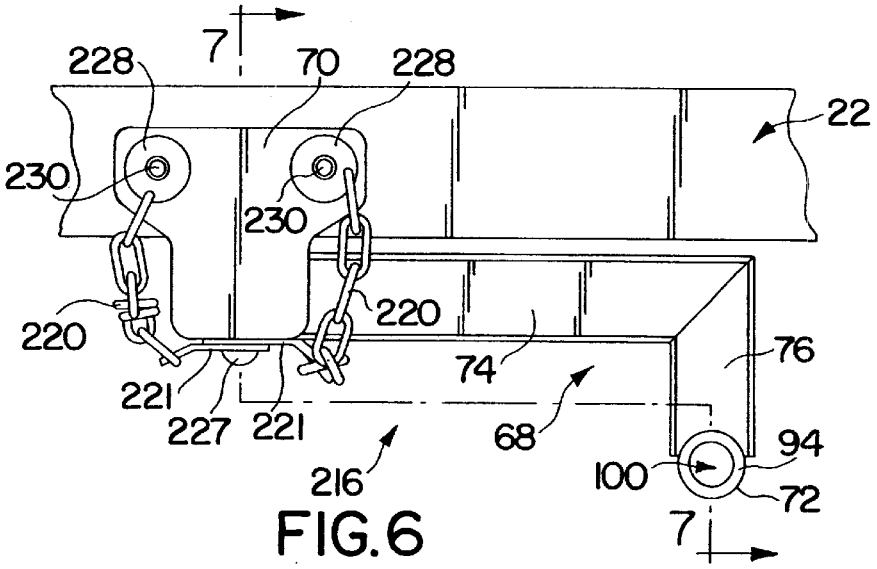
FIG. 6 is a top plan view showing the alternative embodiment mounting bracket of FIG. 5 attached to the intermediate frame of the hospital bed.
Figure 7:
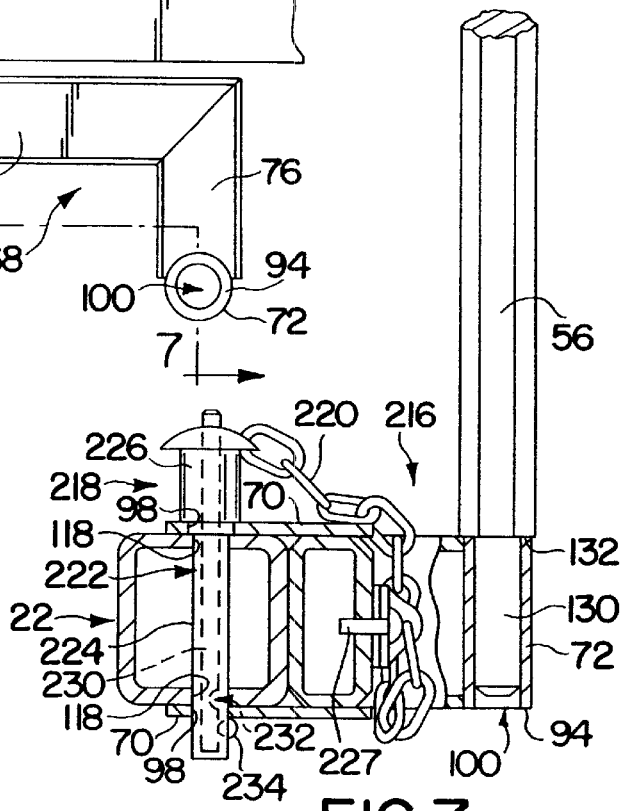
FIG. 7 is a sectional view taken along line 7—7 of FIG. 6 showing one of the mounting pins received in apertures formed in the mounting plates of the alternative embodiment mounting bracket and received in apertures formed in the intermediate frame and showing a lower portion of a fracture frame member received in the vertical socket tube of the alternative embodiment mounting bracket.

An alternative embodiment mounting bracket 216 is shown in FIGS. 5–7. Mounting bracket 216 is substantially the same as mounting bracket 16 and therefore, like reference numerals are used to denote like components. A pair of coupling pins 218 are tethered to mounting bracket 216 by chains 220. Of course, other types of tethers would also work in lieu of chains 220. One link of each chain 220 is coupled to a respective small plate 221. Each small plate 221 is formed to include an aperture 223 and arm 68 is formed to include a threaded aperture 225 in portion 74 as shown in FIG. 5. A small bolt 227 extends through apertures 223 of plates 221 and is threadedly received by aperture 225 to couple chains 220 to mounting bracket 216, thereby coupling pins 218 to mounting bracket 216. Each mounting bracket 216 also includes a cosmetic end plug 229 which closes the open end (not shown) of portion 74 of arm 68.

Each pin 218 includes a tubular shank 222 having a lower cylindrical portion 224, an enlarged upper portion 226, and a head portion 228 as shown in FIG. 5. One link of each chain 220 is attached to respective head portion 228. Each pin 218 further includes a push rod 230 received for axial movement within the bore of tubular shank 222. An upper end of each push rod 230 extends beyond the respective head portion 228 and a recess 232, shown in FIG. 7 (in phantom), is formed adjacent a lower end of each push rod 230. Push rods 230 are spring-biased toward an upward position in a conventional manner.

Each tubular shank 222 includes a small hole formed in a lower portion thereof and each pin 218 includes a detent ball 234, a portion of which projects radially outwardly from shank 222 when push rod 230 is in its upward position. Pushing downwardly on the upper end of push rod 230 causes recess 232 to align with detent ball 234 which permits detent ball 234 to retract into recess 232 such that ball 234 no longer projects from shank 222. When the upper end of push rod 230 is released, rod 230 is automatically spring-biased upwardly and movement of rod 230 upwardly automatically forces ball 234 back to the position having a portion of the ball 234 projecting from shank 222.

To couple mounting bracket 216 to frame 22, mounting bracket 216 is arranged so that frame 22 is received between mounting plates 70 having apertures 98 of mounting plates 70 aligned with respective apertures 118 of frame 22. Upper ends of push rods 230 are then pressed and pins 218 are inserted downwardly through apertures 98, 118. After insertion of pins 218 through apertures 98, 118, the upper end of push rods 230 are released and detent balls 234 project from shank 222 beneath the lower mounting plate 70 of bracket 216 as shown in FIG. 7. Projection of balls 234 beyond respective shanks 222 beneath the lower mounting plate 70 prevents pins 218 from being pulled out of apertures 98, 118. After mounting brackets 216 are coupled to frame 22, fracture frame 14 is coupled to mounting brackets 216 by insertion of lower ends 130 of frame members 56 into bore 100 of socket tubes 72 as was described above with reference to mounting brackets 16.

Mounting brackets 16 and mounting brackets 216 permit easy attachment of fracture frame 14 to hospital bed 12. Brackets 16 are quickly and easily coupled to frame 22 with bolts 120 and wing nuts 128 that are hand tightened to secure brackets 16 to frame 22. Brackets 216 are quickly and easily coupled to frame 22 with pins 218 having push rods 230 that are manipulated manually to secure brackets 216 to frame 22. After attachment of either of brackets 16, 216 to bed 12, fracture frame 14 is easily coupled to brackets 16, 216 by insertion of ends 130 of frame members 56 into bores 100 of respective socket tubes 72. Each of brackets 16 and 216 also quickly and easily detaches from hospital bed 12. Thus, mounting brackets 16, 216 in accordance with the present invention allow attachment and removal of fracture frame 14 relative to hospital bed 12 without the use of tools.

Although the invention has been described in detail with reference to certain illustrated embodiments, variations and modifications exist within the scope and spirit of the invention as described and defined in the following claims.

What is claimed is:

1. A mounting bracket apparatus for coupling a fracture frame to a patient-support apparatus, the mounting bracket apparatus comprising:

an arm including a portion adapted to couple to the fracture frame, a first mounting plate coupled to the arm and extending therefrom, and a second mounting plate coupled to the arm and extending therefrom in parallel and spaced relation with the first mounting plate, the first and second mounting plates being adapted to receive a portion of the patient-support apparatus therebetween.

2. The apparatus of claim 1, wherein the first mounting plate is formed to include a first aperture, the second mounting plate is formed to include a second aperture, and the first and second apertures are aligned.

3. The apparatus of claim 1, wherein the arm includes a structural member coupled to the first and second mounting plates and a socket tube coupled to the structural member.

4. The apparatus of claim 3, wherein the structural member is L-shaped.

5. The apparatus of claim 3, wherein the structural member includes a first end and a second end, the mounting plates are coupled to the first end, and the socket tube is coupled to the second end.

6. The apparatus of claim 1, wherein the arm is formed to include a receptacle adapted to receive a portion of a fracture frame member.

7. The apparatus of claim 1, wherein the patient-support apparatus includes a frame, and a patient-support surface supported by the frame and defining a footprint when projected downwardly onto a floor surface beneath the frame, and wherein the first and second mounting plates are coupled to the frame within the footprint.

8. The apparatus of claim 7, wherein the frame includes a frame member, the first mounting plate being positioned to lie above the frame member and the second mounting plate being positioned to lie below the frame member.

9. The apparatus of claim 8, wherein the first and second mounting plates each are formed to include a first aperture, the frame member is formed to include a second aperture, and the mounting bracket further includes a pin received by all of the first and second apertures to couple the mounting bracket to the frame member.

10. The patient-support apparatus of claim 8, wherein the first and second mounting plates each are formed to include a first aperture, the frame member is formed to include a second aperture, and the mounting bracket further includes a bolt received by all of the first and second apertures to couple the mounting bracket to the frame member.

11. The apparatus of claim 1, wherein the arm has a first horizontal surface and a second horizontal surface spaced apart from the first horizontal surface, the first mounting plate being coupled to the first horizontal surface, and the second mounting plate being coupled to the second horizontal surface.

12. A method of coupling a fracture frame to a patient support apparatus, the method comprising:

providing a bracket comprising an arm including a coupler adapted to couple to a fracture frame, a first mounting plate coupled to the arm and extending therefrom, and a second mounting plate coupled to the arm and extending therefrom in parallel and spaced relation with the first mounting plate, the first and second mounting plates being adapted to receive a portion of a patient support apparatus therebetween, coupling a fracture frame to the coupler of the arm, and coupling a portion of a patient support apparatus between the first and second mounting plates.

13. The method of claim 12, wherein the arm includes a structural member coupled to the first and second mounting plates and the coupler is a socket tube coupled to the structural member spaced apart from the first and second mounting plates.

14. The method of claim 13, wherein the structural member includes a first end portion and a second end portion, the mounting plates being coupled to the first end portion, and the socket tube being coupled to the second end portion.

15. The method of claim 12, wherein the arm has a first horizontal surface and a second horizontal surface spaced apart from the first horizontal surface, the first mounting plate being coupled to the first horizontal surface, and the second mounting plate being coupled to the second horizontal surface.

16. A bracket comprising:

a body having a first end and a second end, the body including first and second segments having first and second beveled ends, respectively, the first and second beveled ends being coupled together to form an L-shaped structural member;

means for coupling the first end of the body to a fracture frame; and means for coupling the second end of the body to a patient support.

17. A bracket comprising:

a body including a hollow tube;

means for coupling the first end of the body to a fracture frame; and means for coupling the second end of the body to a patient support, the means for coupling the first end of the body to a fracture frame being coupled to a first open end of the hollow tube and a plug is coupled to a second open end to the hollow tube.

18. A bracket for coupling a first item to a second item, the bracket comprising:

a body having a first end portion and a second end portion;

a socket tube coupled to the first end portion, the socket tube being configured to receive a portion of a first item therein;

first and second mounting plates coupled to the second end portion, the first mounting plate defining a first plane, the second mounting plate defining a second plane parallel to the first plane, the first and second mounting plates being formed to include first and second apertures, respectively, the first and second apertures being aligned with each other; and a fastener configured to extend through the first and second apertures to couple the second end portion of the body to a second item.

19. The bracket of claim 18, wherein the fastener is coupled to the body by a tether.

20. The bracket of claim 19, wherein the body comprises a hollow tube.

21. The bracket of claim 20, wherein the body includes first and second segments having first and second beveled ends, respectively, the first and second beveled ends being coupled together to form an L-shaped structural member.

22. The bracket of claim 20, wherein the socket tube is coupled to a first open end of the hollow tube and a plug is coupled to a second open end to the hollow tube.

23. The bracket of claim 19, wherein the fastener is a bolt having a treaded portion, the bolt extending through the first and second apertures, the fastener including a nut coupled to the threaded portion of the bolt to secure the bolt to the first and second mounting plates.

24. The bracket of claim 18, wherein the first aperture has a rectangular shape.

25. The bracket of claim 24, wherein the fastener has a portion having a rectangular shape sized and shaped to be received in the first aperture to prevent relative rotation between the fastener and the first mounting plate.

26. The bracket of claim 18, wherein the socket tube defines an aperture having a substantially circular cross section.

27. The bracket of claim 18, wherein the fastener is a pin having a detent ball configured to hold the pin in fixed position relative to the first and second mounting plates.

28. The bracket of claim 27, wherein the pin further includes an enlarged upper portion and a head coupled to the to the body by a tether.

29. The bracket of claim 27, wherein the pin includes a push rod having a recess configured to be selectively aligned with the detent ball to permit the detent ball to retract into recess, thereby permitting the pin to be removed from the first and second mounting plates.

30. The bracket of claim 18, wherein the first mounting plate is formed to include a pair of first apertures, and the second mounting plate is formed to include a pair of second apertures, the fastener being configured to extend through one of the pair of first and second apertures, and further comprising a second fastener configured to extend through the other of the pair of first and second apertures to couple the second end portion of the body to a second item.

31. The bracket of claim 30, wherein the fastener and the a second fastener are each coupled to the body by a tether.

* * * * *